US011305339B2

(12) United States Patent
Johansson et al.

(10) Patent No.: US 11,305,339 B2
(45) Date of Patent: Apr. 19, 2022

(54) ROLL LINE UNIT AND CONTINUOUS CASTING APPARATUS

(71) Applicant: AKTIEBOLAGET SKF, Gothenburg (SE)

(72) Inventors: Mats Johansson, Västra Frölunda (SE); Erik Mitchell, Hovås (SE)

( * ) Notice: Subject to any disclaimer, the term of this patent is extended or adjusted under 35 U.S.C. 154(b) by 0 days.

(21) Appl. No.: 17/082,362

(22) Filed: Oct. 28, 2020

(65) Prior Publication Data

US 2021/0197252 A1 Jul. 1, 2021

(30) Foreign Application Priority Data

Jan. 1, 2020 (DE) ..... 102020200001.8

(51) Int. Cl.
*B22D 11/128* (2006.01)
*B22D 11/06* (2006.01)

(52) U.S. Cl.
CPC ..... *B22D 11/1287* (2013.01); *B22D 11/0682* (2013.01)

(58) Field of Classification Search
CPC ... B22D 11/06; B22D 11/0682; B22D 11/128; B22D 11/1287
USPC ..... 164/442, 448
See application file for complete search history.

(56) References Cited

FOREIGN PATENT DOCUMENTS

WO 2015011149 A2 1/2015

*Primary Examiner* — Kevin P Kerns
(74) *Attorney, Agent, or Firm* — J-TEK Law PLLC; Scott T. Wakeman; Mark A. Ussai

(57) ABSTRACT

A roll line unit for a continuous casting apparatus includes a roll mantle having two ends and a non-rotatable shaft including a coolant line. The roll mantle is rotatably mounted on the non-rotatable shaft by means of a first bearing located in a first end region of the roll mantle and a second bearing located in a second end region of the roll mantle. The roll mantle includes at least one coolant channel having at least one fluid inlet that is arranged to be in fluid communication with the coolant line. The roll line unit includes two outer seals located on an axially outward side of each of the first and second bearings, whereby the outer seals and the first and second bearings are located axially inwards of the ends of the roll mantle.

10 Claims, 5 Drawing Sheets

ROLL LINE UNIT AND CONTINUOUS CASTING APPARATUS

CROSS-REFERENCE

This application claims priority to German Patent Application No. DE 10 2020 200 001.8, filed Jan. 1, 2020, the entire contents of which are fully incorporated herein by reference.

BACKGROUND OF THE INVENTION

The present invention concerns a roll line unit that is suitable for a roll line of a continuous casting apparatus. The present invention also concerns a continuous casting apparatus comprising at least one such roll line unit.

In a continuous casting process molten metal flows from a ladle, through a tundish into a mold having water-cooled walls. Once in the mold, the molten metal solidifies against the water-cooled mold walls to form a solid shell. This shell containing the liquid metal, now called a strand, is withdrawn continuously from the bottom of the mold. The strand is supported by closely spaced, water-cooled roll lines which act to support the walls of the strand against the ferrostatic pressure of the still-solidifying liquid within the strand. To increase the rate of solidification, the strand is sprayed with large amounts of water. Finally, the strand is cut into predetermined lengths. The strand may then continue through additional roll lines and other mechanisms which flatten, roll or extrude the metal product into its final shape.

Since cast metal strands leave the mold at a temperature above 900° C., in particular in the case of steel strands, the roll mantles or roll bodies of the roll lines are usually provided with internal cooling to facilitate cooling of the strands passing over them and to extend the useful service life of the roll mantles or roll bodies.

Apart from high temperatures, the roll lines used in continuous casting plants are also subjected to extreme wear due to the high loads, large temperature variations, high humidity, high corrosion, abrasion, and high contamination to which they are subjected during use. Their service life is relatively short compared with other components used in a continuous casting plant. For this reason, the roll lines have to be exchanged for or replaced with new roll lines or overhauled roll lines frequently. If the roll lines fail, they have to be replaced within the shortest possible time so that down time of the continuous casting plant is minimized. The roll lines are relatively large and heavy, and exchanging them is difficult and time consuming.

International publication no. WO 2015/011149 A2 relates to a strand guide roller for guiding a steel strand in a strand casting machine and to a method for cooling the strand guide roller using a coolant. The aim of the strand guide roller and method is to provide a particularly robust cooled strand guide roller. This is achieved by a strand guide roller having a plurality of support blocks; a stationary axle, the stationary axle being connected to the support blocks in a torsionally rigid manner; a cylindrical roller casing and a left and a right bearing, the roller casing being supported by the left and right bearing in a rotatable manner relative to the stationary axle; and a water conducting casing. The water conducting casing can conduct cooling water from a left cavity between the axle and the water conducting casing in the region of the left bearing into a longitudinal space between the water conducting casing and the roller casing, along the longitudinal space in an axial and a tangential direction, and from the longitudinal space into a right cavity between the water conducting casing and the axle in the region of the right bearing. Such a strand guide roller is quite complex to construct.

SUMMARY OF THE INVENTION

An object of the invention is to provide an improved roll line unit that is suitable for a roll line of a continuous casting apparatus.

This object is achieved by a roll line unit that comprises a roll mantle having two ends and a non-rotatable shaft comprising a coolant line, whereby the roll mantle is rotatably mounted on the non-rotatable shaft by means of a first bearing located in a first end region of the roll mantle and a second bearing located in a second end region of the roll mantle. The roll mantle comprises at least one coolant channel having at least one fluid inlet that is arranged to be in fluid communication with the coolant line. The roll line unit comprises outer seals located on an axially outward side of each of the first and second bearings. The outer seals and the first and second bearings are located axially inwards of the ends of the roll mantle. The roll line unit may also comprise inner seals located on an axially inward side of the first and second bearings, whereby the inner and/or outer seals may be bearing seals or coolant seals.

Accommodating the first and second bearings and outer seals inside the roll mantle axially inwards of the ends of the roll mantle provides a very protected environment for these components in which they are protected from humidity, corrosion and contamination, which may increase the useful service life of these components. Furthermore, the first and second bearing will be cooled to acceptable operating temperatures by the coolant channels of the roll mantle and the cooled roll mantle will prevent or reduce overheating of the outer seals. Such a construction will enable a roll mantle according to the present invention to be used in "fully sealed" or "lubricated for life" roll lines, such as SKF's CONRO™ roll line units, whose lubrication systems contains lubricant of sufficient quality and in a sufficient amount to survive the entire service life of roll line unit.

According to an embodiment of the invention the roll line unit according to the present invention may comprise a support block, whereby the roll mantle of the roll line unit is rotatably supported in relation to the support block. Since the outer seals and the first and second bearings are located axially inwards of the ends of the roll mantle and since the roll line unit comprises a cooled roll mantle, the support block does not need to house outer seals or bearings axially outwards of the ends of the roll mantle. The amount of space that is needed axially outwards of the ends of the roll mantle is thereby reduced, which enables the size and complexity of a support block to be minimized, which will increase a manufacturer's design options and allow a smaller, simpler, more robust and less expensive support blocks to be used.

The expression "outer surface of the roll mantle" as used herein is intended to mean the surface that is arranged to come into contact with cast metal strands during a continuous casting process. The expression "length of the roll mantle" is intended to mean the length of this outer surface as measured from one end of the roller mantle to the other end region of the roller mantle.

The expression "located axially inwards" as used herein is intended to mean that the entire axial extension or length of the outer seals and the first and second bearings are located between the two opposing ends of the roll mantle.

The expression "a shaft" is intended to mean at least one non-rotating bar that is used to support one or more roll mantles. The cross-section of a shaft is usually, but not necessarily, circular. The expression "a shaft" is intended to mean either a single shaft that passes through the entire length of a roll mantle of a roll line unit according to the present invention, or a plurality of shafts which support only the ends of a roller mantle of a roll line unit according to the present invention but do pass through the entire length of the roll mantle.

It should be noted that the expression "a non-rotatable shaft having a coolant line" is not necessarily intended to mean a non-rotatable shaft having a single coolant line. A non-rotatable shaft may be arranged to have any number of coolant lines.

The expression "coolant channel" as used herein is intended to mean any cavity, hole or passage of any shape or size which can contain and/or conduct coolant, such as water or any other fluid (i.e. liquid or gas) or a mixture of fluids.

A roll mantle according to the present invention is not necessarily a hollow cylinder and does not necessarily have a continuous or a smooth outer surface. It can have any uniform or non-uniform, symmetric or non-symmetric shape, size and/or cross section. The outer surface of the roll mantle may be continuous or non-continuous. It may have an even or uneven outer surface, which is either free from perceptible projections or indentations or which contains perceptible projections or indentations.

According to an embodiment of the invention the at least one fluid inlet is located in between the first and second bearings or in between the inner seals.

According to an embodiment of the invention, the roll mantle comprises a first end region, a second end region, and a central region in between the first end region, and the second end region, whereby the at least one coolant channel has at least one inlet located in an end region of the roll mantle and/or at least one outlet located in an end region of the roll mantle, whereby the end regions extend along at least 50% of the length of the roll mantle, or at least 40%, at least 30%, or at least 20% of the length of the roll mantle in total. Alternatively, or additionally, at least one fluid inlet may be located in the central region of the roll mantle.

According to an embodiment of the invention the roll mantle is manufactured in one piece or in a plurality of pieces, by casting or any other suitable manufacturing method.

According to an embodiment of the invention the at least one coolant channel is arranged to extend longitudinally across the first bearing and/or the second bearing to facilitate cooling of the first bearing and/or the second bearing, i.e., part of at least one coolant channel is located radially inwards or radially outwards of the first bearing and/or the second bearing.

According to an embodiment of the invention the at least one coolant channel includes a section that extends at a constant distance from an outer surface of the roll mantle and/or a section that extends at a non-constant distance from an outer surface of the roll mantle.

According to an embodiment of the invention one or more coolant channels may extend from one or more fluid inlets located in a first end region of the roll mantle to one or more fluid outlets located in a second end region of the roll mantle. One or more coolant channels may thereby be arranged to extend substantially over the whole or entire length of the roll mantle, or over at least 70%, at least 80% or at least 90% of the length of the roll mantle.

Alternatively, the at least one coolant channel is arranged to extend along a maximum of 70% of the length of a roll mantle, or a maximum of 60% of the length of a roll mantle or a maximum of 50% of the length of a roll mantle. Shorter coolant channels may be easier to form or produce, by casting or machining for example, than longer coolant channels.

According to an embodiment of the invention the at least one roll mantle comprises at least one fluid outlet that is arranged or configured to be in fluid communication, i.e., fluidly connected, with the coolant line. The at least one fluid outlet may be located in an end region and/or in a central region of the roll mantle in between the first and second bearings or in between the inner seals.

One or more fluid inlets and/or fluid outlets may be arranged in one or both end regions of the roll mantle which are subjected to high loads, high temperatures, high temperature variations, high humidity, high corrosion and high contamination. Coolant seals may be provided between the non-rotatable shaft of the roll line unit and the roll mantle. Rubber seals or O-rings may for example be used to seal off the area between a coolant line of a non-rotatable shaft and the fluid inlet and/or coolant outlet of the roll mantle.

The detrimental effect of these conditions may be reduced or avoided by locating the fluid inlet(s) and/or outlet(s) and any necessary coolant seals in the central region of the roll mantle which is less loaded, more protected, and cooler than the end regions of the roll mantle. The lifetime of coolant seals around the fluid inlet(s) and/or outlet(s) will consequently be extended and the coolant seals will not have to be replaced as frequently as coolant seals located at the end regions of a roll mantle.

According to an embodiment of the invention, coolant seals may be used at the end regions and/or in the central region of the roll mantle. One or more seals may be located next to at least one fluid inlet and/or at least one fluid outlet to reduce the risk of the coolant seal material becoming overheated during use of the roll line unit.

According to an embodiment of the invention the at least one coolant channel extends from the fluid inlet to the fluid outlet in a continuous path.

The present invention also concerns a roll line for a continuous casting apparatus which comprises at least one or a plurality of roll line units according to any of the embodiments of the present invention. The one or more roll line units according to the present invention may for example be incorporated in a bloom caster, slab caster, beam blank caster. It should be noted that a plurality of roll line units according to the present invention may be arranged in any suitable manner or configuration in a continuous casting apparatus to facilitate the transport of a strand, billet, bloom or slab of steel. A plurality of roll line units may for example be placed in a single line, optionally mounted on a common non-rotatable shaft, or on a polygonal frame of any suitable size or shape.

The present invention also concerns a continuous casting apparatus, which comprises at least one roll line unit according to any of the embodiments of the invention.

The present invention also concerns a method for manufacturing a roll line unit according to any of the embodiments of the present invention. According to an embodiment of the invention, the method comprises the step of producing a roll mantle of the roll line unit by casting.

The expression "casting" may include sand, continuous or die casting, whereby a molten metal is poured into a mold which contains a hollow cavity of the desired shape, and then allowed to solidify. The solidified part is ejected or broken out of the mold to complete the process.

According to an embodiment of the invention, the method comprises the step of manufacturing a roll mantle comprising at least one coolant channel in a single piece and/or from a single material. The roll mantle is preferably made of a relatively corrosion resistant material, such as a low carbon steel (i.e. steel having a maximum carbon content of 0.1 percent by weight). The roll mantle according to the present invention may alternatively be made from any suitable metal or metal alloy, such as steel, a high-strength steel, martensitic steel, or martensitic stainless steel. The roll mantle according to the present invention may be "hard-faced", i.e. it may include a harder or tougher material which has been applied to at least part of a base material constituting the roll mantle.

According to an embodiment of the invention, the method comprises the step of casting the at least one coolant channel so that it comprises at least one of the following features: a pattern, and/or at least one feature, such as a projection on at least part of its inner surface to achieve at least one of the following: to control a flow of fluid flowing through the at least one coolant channel; to create turbulence in a fluid flowing through the at least one coolant channel; to provide an increased contact surface area to facilitate cooling of a the roll mantle; and/or to facilitate mounting of equipment, such as a sensor, that is to be placed in the at least one coolant channel; a pattern, and/or at least one feature, such as a projection on at least part of an outer surface of said roll mantle; a uniform or non-uniform cross-section; a uniform or non-uniform cross-sectional area; a section that extends at a constant or non-constant distance from an outer surface of the roll mantle; a circular cross-section; a rounded or smooth inside surface; a conical geometry and/or a partition wall.

BRIEF DESCRIPTION OF THE DRAWINGS

The present invention will hereinafter be further explained by means of non-limiting examples with reference to the appended schematic figures. It should be noted that the drawings have not been drawn to scale and that the dimensions of certain features have been exaggerated for the sake of clarity. In the drawings.

DETAILED DESCRIPTION OF EMBODIMENTS

Figure 1:
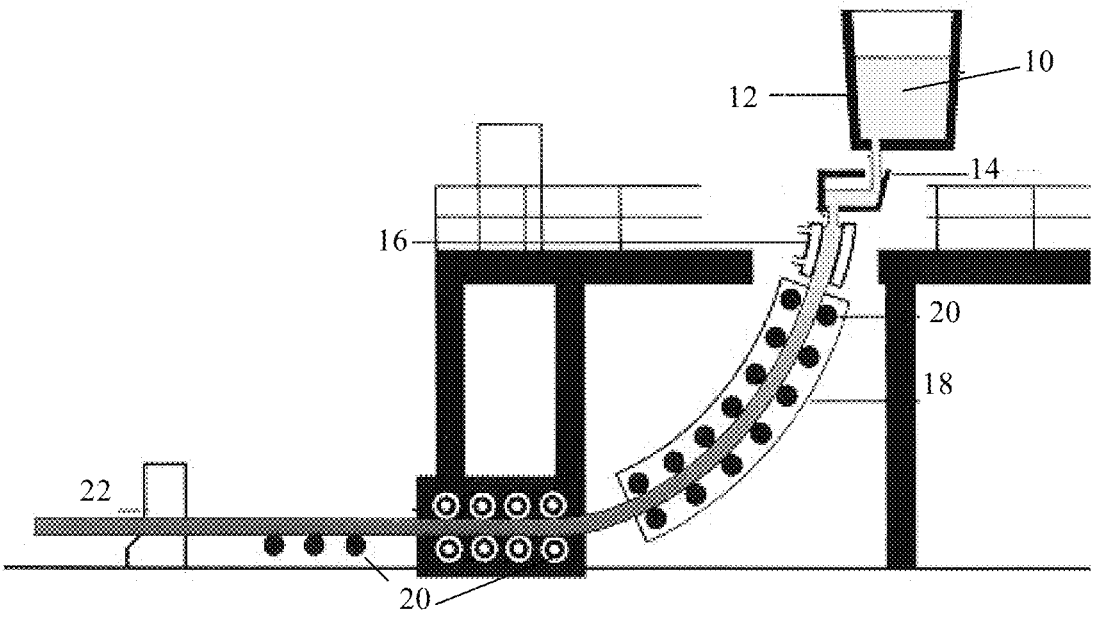
FIG. 1 shows a continuous casting apparatus.

FIG. 1 shows a continuous casting apparatus in which molten metal 10 is tapped into a ladle 12. After undergoing any ladle treatments, such as alloying and degassing, and arriving at the correct temperature, molten metal 10 from the ladle 12 is transferred via a refractory shroud to a tundish 14. Metal is drained from the tundish 14 into the top of an open-base mold 16. The mold 16 is water-cooled to solidify the molten metal directly in contact with it. In the mold 16, a thin shell of metal next to the mold walls solidifies before the middle section, now called a strand, exits the base of the mold 16 into a cooling chamber 18; the bulk of metal within the walls of the strand is still molten. The strand is supported by closely spaced, water-cooled roll lines 20 which act to support the walls of the strand against the ferrostatic pressure of the still-solidifying liquid within the strand. To increase the rate of solidification, the strand is sprayed with large amounts of water as it passes through the cooling chamber 18. Final solidification of the strand may take place after the strand has exited the cooling chamber 18.

In the illustrated embodiment the strand exits the mold 16 vertically (or on a near vertical curved path) and as it travels through the cooling chamber 18, the roll lines 20 gradually curve the strand towards the horizontal. (In a vertical casting machine, the strand stays vertical as it passes through the cooling chamber 18).

After exiting the cooling chamber 18, the strand passes through straightening roll lines (if cast on other than a vertical machine) and withdrawal roll lines. Finally, the strand is cut into predetermined lengths by mechanical shears or by travelling oxyacetylene torches 22 and either taken to a stockpile or the next forming process. In many cases the strand may continue through additional roll lines and other mechanisms which might flatten, roll or extrude the metal into its final shape.

Figure 2:
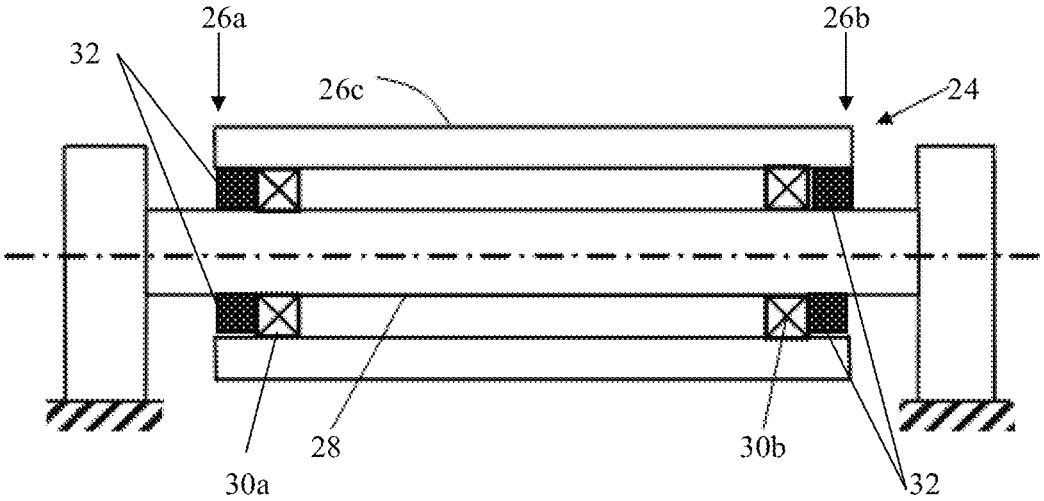
FIG. 2 shows a roll line unit according to an embodiment of the invention comprising a roll mantle mounted on a non-rotatable shaft.

FIG. 2 shows a roll line unit 24 according to an embodiment of the invention. The roll line unit 24 comprises a roll mantle 26 having two, first and second ends 26*a*, 26*b*, respectively, and a non-rotatable shaft 28 comprising a coolant line (not shown in FIG. 2). The roll mantle 26 is rotatably mounted on the non-rotatable shaft 28 by means of a first bearing 30*a* located in a first end region ER1 of the roll mantle 26 and adjacent to the first end 26*a* of the mantle 26, and a second bearing 30*b* located in a second end region ER2 of the roll mantle 26 and adjacent to the second end 26*b* of the mantle 26. The roll mantle 26 comprises at least one coolant channel (not shown in FIG. 2) having at least one fluid inlet that is arranged to be in fluid communication with, i.e., fluidly connected with, the coolant line of the non-rotatable shaft 28, as described below. The roll line unit 24 comprises two outer seals 32 located on an axially outward side of each of the first and second bearings 30*a*, 30*b*, whereby the outer seals 32 and the first and second bearings 30*a*, 30*b* are located axially inwards of the ends 26*a*, 26*b*, respectively, of the roll mantle 26. More specifically, a first outer seal 32 is located on an axially outward side of first bearing 30*a* and axially inward of the first end 26*a* of the roll mantle 26 and a second outer seal 32 is located on an axially outward side of the second bearing 30*b* and axially inward of the second end 26*b* of the roll mantle 26.

Figure 3:
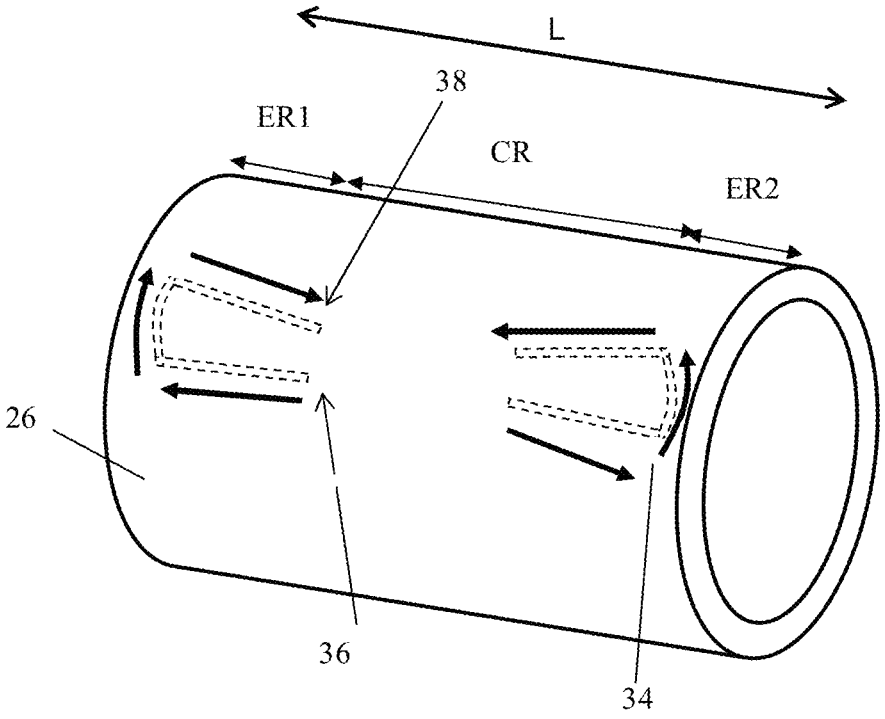
FIG. 3 shows a roll mantle of a roll line unit according to an embodiment of the invention.

FIG. 3 shows a roll mantle 26 comprising a plurality of fluid channels 34 that may be used to conduct coolant through the roll mantle 26 when the roll mantle 26 is in use, whereby only two fluid channels 34 have been illustrated. The length L of a roll mantle 26 may be between 100 millimeters (mm) and 1200 mm, or any other desired and/or appropriate length. Further, the roll mantle 26 is not necessarily cylindrical and does not necessarily have a continuous or a smooth outer surface. It can have any uniform or non-uniform, symmetric or non-symmetric shape, size and/or cross section. According to an embodiment of the invention the roll mantle 26 including the at least one coolant channel 34 may be produced or fabricated in a single piece from a single material, preferably a corrosion resistant material, or in a plurality of pieces from one or more materials.

A plurality of axial fluid channels 34 may extend in any suitable manner inside the roll mantle 26. A roll mantle 26 may for example be provided with peripheral bore cooling (also called revolver cooling) and skewed fluid channels 34. The at least one fluid channel 34 of a roll mantle 26 according to the present invention may contain one or more fluid channels 34 arranged in any axial, non-axial, radial, non-radial, symmetrical, non-symmetrical, regular or irregular manner, as desired. One or more coolant channels 34 may for example be arranged in a spiral or circumferential arrangement. The fluid inlets 36 and outlets 38 may be arranged in one or both end regions ER1 and/or ER2 of the roll mantle 26 or in a central region CR of the roll mantle 26.

Figure 4:
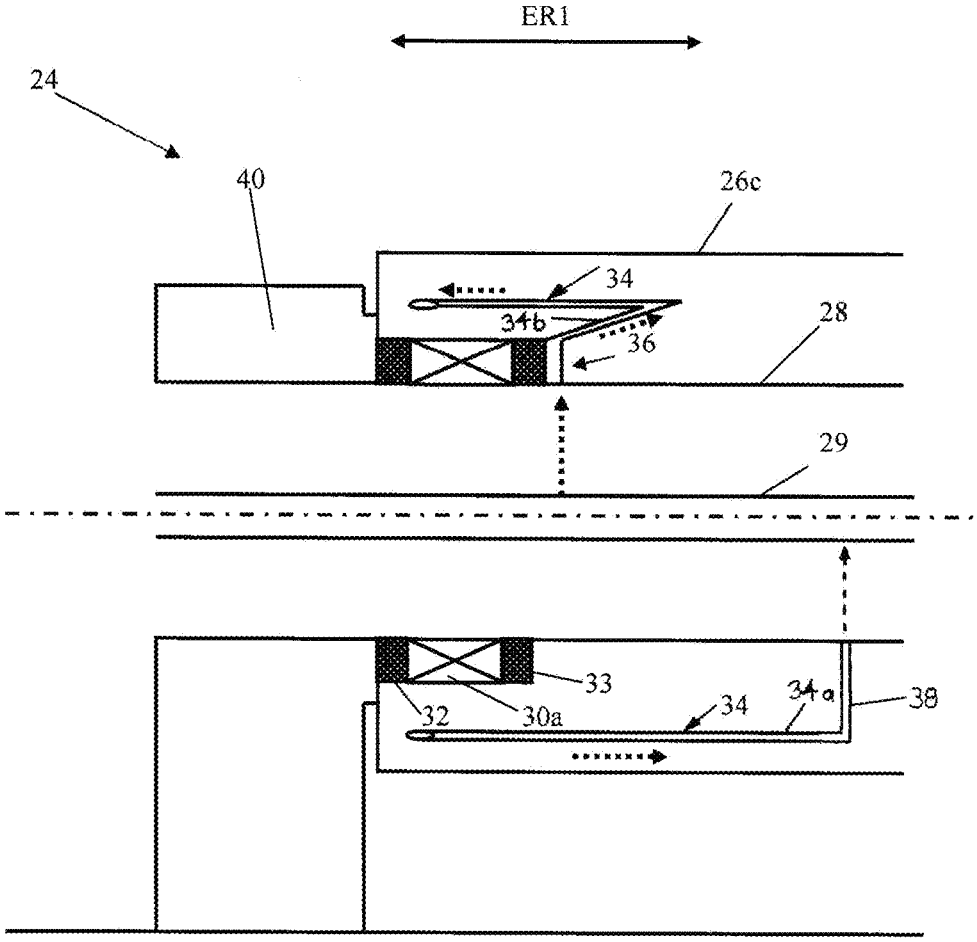
FIG. 4 shows a cross section of one end of a roll line unit according to an embodiment of the invention.

FIG. 4 shows one end of a roll line unit 24 according to an embodiment of the invention. The roll line unit 24 comprises a roll mantle 26 having two ends and a non-rotatable shaft 28 comprising a coolant line 29, whereby the roll mantle 26 is rotatably mounted on the non-rotatable shaft 28 by means of the first bearing 30*a* located in the first end region ER1 of the roll mantle 26 and the second bearing 30*b* (not shown in FIG. 4) located in the second end region ER2 (not shown in FIG. 4) of the roll mantle 26. The roll line unit 24 preferably includes outer seals 32 located on an axially outward side of each of the first and second bearings 30*a*, 30*b* and inner seals 33 located on an axially inward side of each of the first and second bearings 30*a*, 30*b*. Thereby, the outer seals 32, the inner seals 33 and the first and second bearings 30*a*, 30*b* are located axially inwards of the adjacent ends 26*a*, 26*b*, respectively, of the roll mantle 26. The outer seals 32 may for example be provided between the non-rotatable shaft 28 and the roll mantle 26 and/or between the first and second bearings 30*a*, 30*b* and the adjacent end 26*a*, 26*b*, respectively, of the roll mantle 26. The outer seals 32 may be bearing seals formed or configured to protect the first and second bearings 30*a*, 30*b* from contamination. Further, the inner seals 33 may be coolant seals.

The first and second bearings 30*a*, 30*b*, respectively, rotatably connect the roll mantle 26 to a support block 40. The support block 40 does not house the first and second bearings 30*a*, 30*b* or the outer seals 32 and the inner seals 33 since these components are contained within the roll mantle 26. The support block 40 provides an extra barrier against humidity, corrosion and contamination.

The size of a support block 40 of a roll line according to the present invention may thereby be minimized and its design can be simplified compared to conventional housings since space is not needed to house bearings and outer seals axially outwards of the ends 26*a*, 26*b* of the roll mantle 26. The support block 40 of a roll line according to the present invention will therefore occupy less space and/or may be used to house components such as lubrication system components. A roll line unit 24 according to the present invention is thereby particularly suitable for use in a continuous casting apparatus, where there is a space limitation around the roll line unit(s) 24, such in the corners of a frame on which a plurality of roll line units 24 are mounted or between roll line units 24.

The non-rotatable shaft 28 includes a coolant line 29 and the fluid channels 34 of the roll mantle 26 are arranged to be in fluid communication with/fluidly connected with the coolant line 29 of the non-rotatable shaft 28. Coolant, such as water or any other suitable fluid or mixture of fluids, may be supplied to the coolant line 29 of the non-rotatable shaft 28, directly or via the support block 40, or via a sub-frame supporting the at least one roll line unit 24, for example. Coolant may then be fed from the coolant line 29 of the non-rotatable shaft 28 to the fluid channels 34 of the roll mantle 26 via one or more fluid inlets 36 at the center of the roll mantle 26 and/or at one or both end regions ER1 and/or ER2 of the roll mantle 26.

Coolant may flow out of the roll mantle 26 via one or more fluid outlets 38 located at the center of the roll mantle 26, and/or at one or both end regions ER1 and/or ER2 of the roll mantle 26, and/or at the sides of the roll mantle 26, whereby coolant that has passed through the at least one fluid channel 34 of the roll mantle 26 may be returned to a coolant line 29 of the non-rotatable shaft 28 or to a support block or sub-frame supporting the at least one roll line unit 24. Coolant may be arranged to be fed from one roll line unit 24 to an adjacent roll line unit 24 via one or more support blocks 40 or via a sub-frame supporting a plurality of roll line units 24. Coolant may enter a roll mantle at one end region ER1, flow through the roll mantle 26 in any desired manner, and then leave the roll mantle 26 at the opposite end region ER2. Alternatively, coolant may enter and leave the roll mantle 26 within the same end region ER1 or ER2, i.e. near the same side 26*a* or 26*b* of the roll mantle 26.

Since a roll mantle 26 of a roll line unit 24 according to the present invention rotates with respect to a non-rotatable shaft 28, coolant has to be supplied from a stationary coolant line 29 of a non-rotatable shaft 28 to a rotating roll mantle 26, i.e. there is a static to dynamic coupling between the non-rotatable shaft 28 and the roll mantle 26.

At least one fluid inlet 36 and at least one fluid outlet 38 of a fluid channel 34 may be in fluid communication with a coolant line 29 of a non-rotatable shaft 28 via one or more radial or non-radial channels in the non-rotatable shaft 28. It should however be noted that fluid communication between the fluid inlet 36 of a fluid channel 34 and the coolant line 29 of a non-rotatable shaft 28 may be provided in any suitable manner.

Coolant from a coolant line 29 of a non-rotatable shaft 28 may be made to flow (by means of pumps, valves and fluid distributors for example) into a plurality of fluid inlets 36 that may be arranged around the inner surface of the roll mantle 26 in an end region ER1 thereof. Coolant then flows in a continuous path along coolant channels 34 in the roll mantle 26 and is returned to the coolant line 29 in the non-rotatable shaft 28 via at least one fluid outlet 38 that may be arranged around the inner surface of the roll mantle 26 in the opposite end region ER2 thereof.

In the illustrated embodiment, when the roll mantle 26 is in use, coolant enters the coolant channel 34 via a fluid inlet 36 in the end region ER1 of the roll mantle 26 and flows longitudinally across the first bearing 30*a* radially above and/or below (i.e., located radially outwardly from) the first bearing 30*a* in the direction indicated by the dotted arrows in FIG. 4. A fluid outlet 38 may be located at the opposite end region ER2 of the roll mantle 26, whereby coolant is arranged to flow substantially along the whole length of the roll mantle 26, within the first end region ER1 or within the central region CR.

A roll mantle 26 of a roll line 24 according to an embodiment of the invention may comprise a plurality of fluid channels 34 having any suitable cross section, such as a circular cross section, which extend mainly in the longitudinal direction of the roll mantle 26.

According to an embodiment of the invention the at least one coolant channel 34 includes a section 34*a* that extends at a constant distance from an outer surface 26*c* of the roll mantle 26 (as shown in FIG. 4 for example). Alternatively or additionally, the at least one coolant channel 34 includes a section 34*b* that extends at a non-constant distance from an outer surface 26*c* of the roll mantle 26 (as also shown in FIG. 4), which may be arranged to extend at an angle of less than 90° to the coolant line 29 of a non-rotatable shaft 28 on which the roll mantle 26 is rotatably mounted when in use.

The one or more coolant channels 34 may however be arranged at any suitable location and have any suitable section so as to provide efficient cooling of the roll mantle 26. Further, each coolant channel 34 may have a uniform or non-uniform cross-section and a uniform or non-uniform cross-sectional area.

Figure 5:
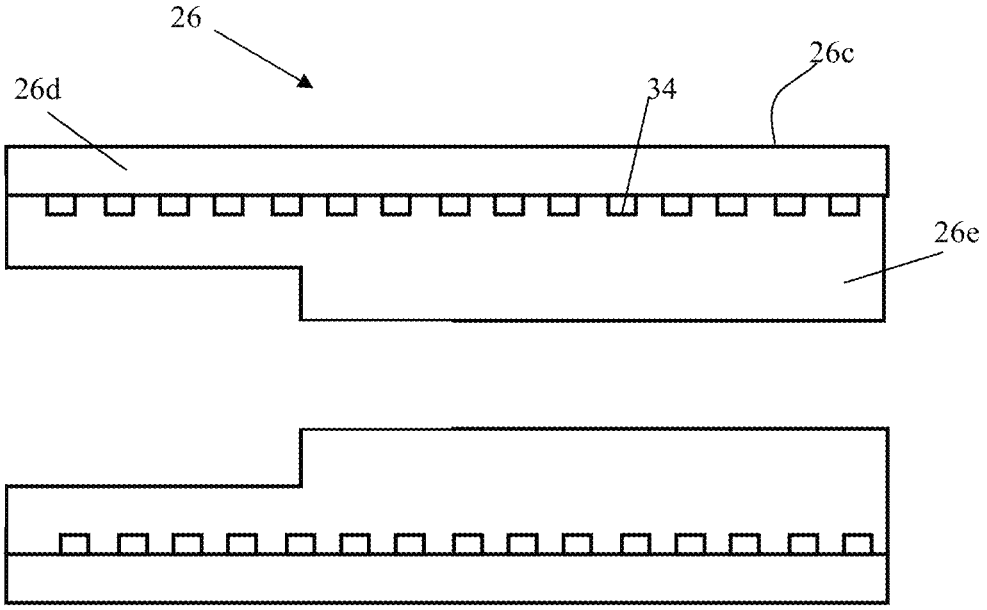
FIG. 5 shows a two-piece roll mantle of a roll line unit according to an embodiment of the invention.

FIG. 5 shows a two-piece roll mantle of a roll line unit according to an embodiment of the invention. A first part 26*d* of the roll mantle 26 comprises the outer roll mantle surface 26*c* and a second part 26*e* of the roll mantle 26 comprises a plurality of cavities, such as spiral, axial or circumferential cavities that form at least one coolant channel 34 when the two-piece roll mantle 26 is in use. The first and second parts 26*d*, 26*e* of a roll mantle 26 may be manufactured in any suitable manner.

Figure 6:
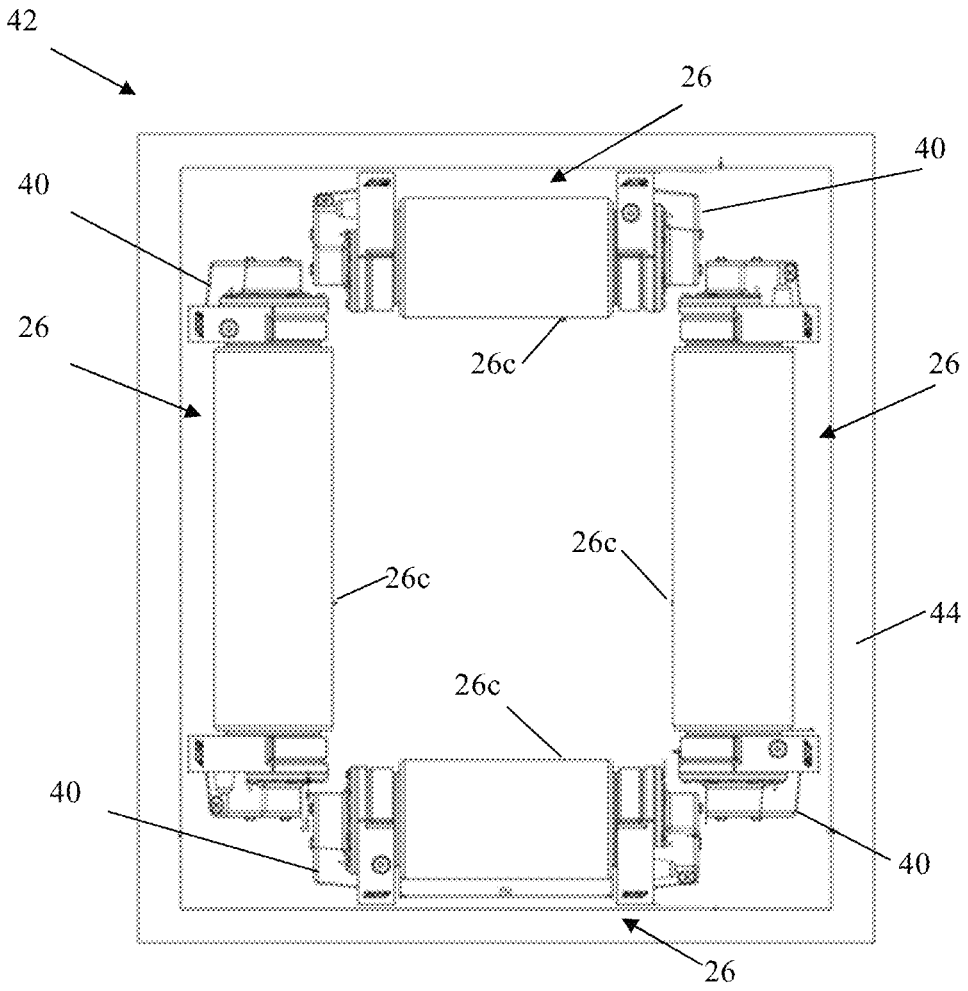
FIG. 6 shows a continuous caster comprising four roll line units according to an embodiment of the invention.

FIG. 6 shows a continuous caster 42, such as a bloom caster, billet caster, slab caster or beam blank caster, comprising four roll line units 24 according to an embodiment of the invention. In the illustrated embodiment the roll line units 24 are of two different lengths which are mounted end to end in on a frame 44 in a rectangular formation. It should be noted that a roll line 20 can contain any number of roll line units 24 arranged in any suitable manner, such as end to end or side by side in a straight line.

Each roll line unit 24 comprises an exposed roll mantle surface 26*c* that is rotatable relative to a support block 40. A support block 40 may be placed at each end of a roll line unit 24. The roll mantle surface 26*c* is arranged to come into contact with steel strands, blooms, billets, slabs or beam blanks for example, which are transported through the frame 44 in a direction at a right angle into or out of the plane of the paper.

Representative, non-limiting examples of the present invention were described above in detail with reference to the attached drawings. This detailed description is merely intended to teach a person of skill in the art further details for practicing preferred aspects of the present teachings and is not intended to limit the scope of the invention.

Moreover, combinations of features and steps disclosed in the above detailed description may not be necessary to practice the invention in the broadest sense and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter. The invention is not restricted to the above-described embodiments, and may be varied within the scope of the following claims.

We claim:

1. A roll line unit for a continuous casting apparatus comprising:

a roll mantle having a first end, a second end and an outer working surface configured to support a metal strand and extending entirely between the first end and the second end;

a non-rotatable shaft including a coolant line;

first and second bearings rotatably mounting the roll mantle to the shaft, the first bearing being located within a first end of the roll mantle outer working surface and the second bearing being located within a second end of the roll mantle outer working surface; and first and second outer seals, the first outer seal being located on an axially outward side of the first bearing and entirely axially inward of the first end of the roll mantle outer working surface, the second outer seal being located on an axially outward side of the second bearing and entirely axially inward of the second end of the roll mantle outer working surface;

wherein the roll mantle has at least one coolant channel with at least one fluid inlet arranged to be in fluid communication with the coolant line of the shaft.

2. The roll line unit according to claim 1, wherein the at least one fluid inlet is located between the first and second bearings.

3. The roll line unit according to claim 1, wherein the roll mantle is manufactured in one piece or in a plurality of pieces.

4. The roll line unit according to claim 1, wherein the at least one coolant channel is arranged to extend longitudinally across at least one of the first bearing and the second bearing.

5. The roll line unit according to claim 1, wherein the at least one coolant channel includes a section that extends at a constant distance from an outer surface of the roll mantle.

6. The roll line unit according to claim 1, wherein the at least one coolant channel includes a section that extends at a non-constant distance from an outer surface of the roll mantle.

7. The roll line unit according to claim 1, wherein the roll mantle includes at least one fluid outlet arranged to be in fluid communication with the coolant line.

8. The roll line unit according to claim 7, wherein the at least one fluid outlet is located between the first and second bearings.

9. The roll line unit according to claim 8, wherein the at least one coolant channel extends from the at least one fluid inlet to the at least one fluid outlet in a continuous path.

10. A continuous casting apparatus comprising:

at least one roll line unit including:

a roll mantle having a first end, a second end and an outer working surface configured to support a metal strand and extending entirely between the first end and the second end;

a non-rotatable shaft including a coolant line;

first and second bearings rotatably mounting the roll mantle to the shaft, the first bearing being located within a first end of the roll mantle outer working surface and the second bearing being located within a second end of the roll mantle outer working surface; and first and second outer seals, the first outer seal being located on an axially outward side of the first bearing and entirely axially inward of the first end of the roll mantle outer working surface, the second outer seal being located on an axially outward side of the second bearing and entirely axially inward of the second end of the roll mantle outer working surface;

wherein the roll mantle has at least one coolant channel with at least one fluid inlet arranged to be in fluid communication with the coolant line of the shaft.

* * * * *